US008309292B2

(12) United States Patent
Sasaki et al.

(10) Patent No.: US 8,309,292 B2
(45) Date of Patent: Nov. 13, 2012

(54) POLYESTER RESIN FOR ELECTROSTATIC IMAGE DEVELOPING TONER AND MANUFACTURING METHOD OF THE SAME, ELECTROSTATIC IMAGE DEVELOPING TONER, ELECTROSTATIC IMAGE DEVELOPER AND IMAGE FORMING APPARATUS

(75) Inventors: Yuki Sasaki, Kanagawa (JP); Masaki Hirakata, Kanagawa (JP); Hideo Maehata, Kanagawa (JP); Hirotaka Matsuoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 561 days.

(21) Appl. No.: 12/540,029

(22) Filed: Aug. 12, 2009

(65) Prior Publication Data

US 2010/0196817 A1 Aug. 5, 2010

(30) Foreign Application Priority Data

Feb. 3, 2009 (JP) ..... 2009-022238

(51) Int. Cl.
*G03G 9/00* (2006.01)

(52) U.S. Cl. ..... 430/109.4; 430/109.1; 525/437

(58) Field of Classification Search ..... 430/108.1, 430/108.7, 109.1, 109.4, 110.2; 525/418, 525/437

See application file for complete search history.

(56) References Cited

U.S. PATENT DOCUMENTS

| | | | | |
|---|---|---|---|---|
| 5,672,454 | A * | 9/1997 | Sasaki et al. | 430/110.2 |
| 6,130,018 | A * | 10/2000 | Kawata et al. | 430/111.35 |
| 6,632,883 | B2 | 10/2003 | Mayes et al. | |
| 7,485,401 | B2 | 2/2009 | Matsumura et al. | |
| 7,538,157 | B2 | 5/2009 | Mayes et al. | |
| 2004/0132920 | A1 * | 7/2004 | Matsumura et al. | 525/418 |
| 2005/0245694 | A1 | 11/2005 | Matsumura et al. | |
| 2007/0048647 | A1 * | 3/2007 | Daimon et al. | 430/110.2 |
| 2007/0073000 | A1 | 3/2007 | Mayes et al. | |
| 2007/0092823 | A1 | 4/2007 | Matsumura et al. | |

FOREIGN PATENT DOCUMENTS

| | | |
|---|---|---|
| GB | 1 431 699 | 4/1976 |
| JP | A-49-017739 | 2/1974 |
| JP | A-57-201246 | 12/1982 |
| JP | A-58-086557 | 5/1983 |
| JP | A-61-056355 | 3/1986 |
| JP | A-2004-264320 | 9/2004 |
| JP | A-2005-060645 | 3/2005 |
| JP | A-2006-516299 | 6/2006 |
| JP | A-2007-114635 | 5/2007 |
| JP | A-2008-083711 | 4/2008 |

* cited by examiner

*Primary Examiner* — Mark F Huff
*Assistant Examiner* — Stewart Fraser
(74) *Attorney, Agent, or Firm* — Oliff & Berridge, PLC

(57) ABSTRACT

A polyester resin for electrostatic image developing toner includes: two or more polyester blocks, and the polyester resin satisfying the following conditions (A) to (C): (A) an ester concentration of the polyester resin is about 0.01 or more and less than about 0.1; (B) a weight average molecular weight of the polyester resin is about 24,000 or more; and (C) a difference in SP values of at least two kinds of the two or more polyester blocks is about 0.1 to about 0.7.

19 Claims, No Drawings

POLYESTER RESIN FOR ELECTROSTATIC IMAGE DEVELOPING TONER AND MANUFACTURING METHOD OF THE SAME, ELECTROSTATIC IMAGE DEVELOPING TONER, ELECTROSTATIC IMAGE DEVELOPER AND IMAGE FORMING APPARATUS

CROSS-REFERENCE TO RELATED APPLICATION

This application is based on and claims priority under 35 USC 119 from Japanese Patent Application No. 2009-022238 filed Feb. 3, 2009.

BACKGROUND

1. Technical Field

The present invention relates to polyester resin and the manufacturing method of the same, an electrostatic image developing toner, an electrostatic image developer, a toner cartridge, a process cartridge, an image-forming method, and an image-forming apparatus.

2. Related Art

A positive charge developing toner for use in electrophotographic system is strongly required, to cope with the demand for reduction of energy consumption in recent years, to be capable of fixation at lower temperature, and for shortening the time from turning on electricity to the apparatus to the start of use, a toner that does not generate offset at a high temperature region having what is called a wide latitude of fixation is eagerly demanded.

As a means for lowering fixing temperature of a toner, it is known to use a polycondensation type crystalline resin showing sharp melting behavior to temperature as a binder resin constituting a toner. However, a toner using a large amount of binder resin is liable to cause yield deformation, and when such a resin is practically used in a toner, troubles such as filming to a photoreceptor by crushing of toner and reduction of transfer effect by aging cannot be avoided.

On the other hand, various trials have been done concerning pressure fixation at ordinary temperature.

SUMMARY

According to an aspect of the invention, there is provided a polyester resin for electrostatic image developing toner, including:

two or more polyester blocks, and the polyester resin satisfying the following conditions (A) to (C):

(A) an ester concentration of the polyester resin is about 0.01 or more and less than about 0.1;

(B) a weight average molecular weight of the polyester resin is about 24,000 or more; and (C) a difference in SP values of at least two kinds of the two or more polyester blocks is about 0.1 to about 0.7.

DETAILED DESCRIPTION

The invention will be described in detail below.

(Polyester Resin for Electrostatic Image Developing Toner)

The polyester resin for an electrostatic image developing toner in the invention (hereinafter also referred to as "polyester resin of the invention", or "blocked polyester resin", or "polyester block copolymer" in some cases) has two or more polyester blocks and satisfies the following conditions (A) to (C):

(A) the ester concentration of the polyester resin is 0.01 or more and less than 0.1 or about 0.01 or more and less than about 0.1;

(B) the weight average molecular weight of the polyester resin is 24,000 or more or about 24,000 or more; and (C) the difference in the SP values of at least two kinds of the polyester blocks is 0.1 to 0.7 or about 0.1 to about 0.7.

When environment is shifted from high temperature high humidity (28° C., 85% HR) environment to low temperature low humidity (10° C., 30% RH) environment, dew condensation is liable to occur in a toner, image-forming apparatus and recording-receiving medium. For example, moisture absorption and deformation are liable to be generated on paper of a recording-receiving medium. In such an environmental change, not only moisture brings influence on toner but also the toner is relatively hard since the temperature is low, and the effect of improvement of flowability by heat cannot be obtained, so that phase migration and mutual dissolution by pressure are difficult to occur.

As a result of examinations, it has been found that excellent pressure flowability can be achieved by controlling the ester concentration and weight average molecular weight of the blocked polyester resin, and the difference in the SP values (solubility parameter values) of at least two kinds of the polyester blocks constituting the block even when shifted from under high temperature high humidity environment to under low temperature low humidity environment. Details with respect to this mechanism are under examination but it is thought as follows.

The ester concentration is a parameter to control affinity of toner and water, and it is presumed that water amount contained in the toner can be adjusted by designing the polyester to become proper ester concentration.

The weight average molecular weight of the blocked polyester resin regulates response to the pressure applied to the polyester resin and viscoelasticity of the resin. By properly controlling molecular chain, the state of phase separation before application of pressure, revelation of flowability ascribable to pressure and mutual dissolution, and migration to the state of phase separation after pressure are presumably performed swiftly.

SP value regulates compatibility of polyesters to each other constituting the block, and it is supposed that sufficient mutual dissolution (i.e. compatibility) can be obtained by proper control even when the environment is shifted from under high temperature high humidity environment to under low temperature low humidity environment.

The ester concentration in the invention is computed from the kinds of the monomers constituting the block polyester by the following equation (1).

$$M=K/A \quad \text{(Equation 1)}$$

In the equation, M represents ester concentration, K represents the number of ester bonds in the polyester resin, and A represents the number of atoms constituting the polymer chain of the polyester resin.

When ester concentration is less than 1.0, it means to be excellent in pressure transmission under highly humidity environment. Ester concentration can be controlled by the kind of the monomer to be selected.

Incidentally, "ester concentration M" is an index showing the proportion of the content of the ester bonds in the polyester resin. "The number of ester bonds in the polyester resin"

represented by K in equation (1) means, in other words, the number of ester bonds contained in the polyester resin at large.

"The number of atoms constituting the polymer chain of the polyester resin" represented by A in equation (1) is the total number of the atoms constituting the polymer chain of the polyester resin and all the number of atoms relating to ester bonding is included, but the atom number of the branched parts of other constitutional parts is not included. That is, carbon atoms and oxygen atoms derived from carboxyl groups and alcohol groups relating to ester bonding (oxygen atoms in one ester bond are two), and six carbon atoms in the aromatic ring and alicyclic ring constituting the polymer chain are included in the computation of the atom number, but hydrogen atoms and other atoms or atomic groups of the substituents in, e.g., aromatic ring and alkyl group constituting the polymer chain are not included in the above computation of the atom number.

Describing with specific examples, of the total ten atoms of six carbon atoms and four hydrogen atoms in the arylene group constituting the polymer chain, the atoms included in the above "the number of atoms constituting the polymer chain of the polyester resin" are six carbon atoms alone, and by what a substituent the oxygen atom is substituted, the atoms constituting the substituent are not included in "the number of atoms constituting the polymer chain of the blocked polyester resin".

In the case where a polyester resin is a homopolymer consisting of one repeating unit alone (for example, when the polyester resin is represented by $HO—[COR^1COOR^2O]_n—H$, one repeating unit is the one in the parentheses, $R^1$ and $R^2$ are each monovalent group, and n is an integer of 1 or more), two ester bonds are present in one repeating unit (that is, ester group number in the repeating unit K'=2), so that ester concentration M can be found according to the following equation (1-1). Since contribution of the terminal parts of a polyester resin is very small as compared with the repeating unit number constituting other polymer, such terminal parts are not taken into consideration.

$$\text{Ester concentration } M=2/A' \quad \text{(Equation 1-1)}$$

In equation (1-1), A' is the number of atoms constituting a polymer chain in one repeating unit.

Further, when the polyester resin is a copolymer consisting of a plurality of copolymer units, ester concentration can be found by finding the number of ester bonds KX and atom number AX constituting the polymer chain with every copolymer unit, multiplying them with copolymerization ratio, adding each value together and substituting the sum for equation (1).

For example, ester concentration M of a polyester resin $[(Xa)_a(Xb)_b(Xc)_c]$ in which the copolymer units are three of Xa, Xb and Xc, and the copolymerization ratio (molar ratio) is a/b/c (provided that a+b+c=1) can be found according to the following equation (1-2).

$$\text{Ester concentration } M=[KXa\times a+KXb\times b+KXc\times c]/[AXa\times a+AXb\times b+AXc\times c] \quad (1\text{-}2)$$

(in equation (1-2), KXa, KXb and KXc represent the number of ester bonds in the copolymer unit Xa, copolymer unit Xb, and copolymer unit Xc respectively, and AXa, AXb and AXc represent the number of atoms constituting the polymer chains in the copolymer units Xa, Xb and Xc respectively.

Ester concentration in the present specification is a value found according to the above calculating method.

The weight average molecular weight Mw of the polyester resin in the invention is 24,000 or more, preferably 24,000 to 1,000,000, more preferably 24,500 to 500,000, and still more preferably 30,000 to 50,000. When Mw is in the above range, the polyester resin is excellent in pressure fixing ability.

Further, the weight average molecular weight Mw of at least two polyester blocks in the polyester resin in the invention is preferably 8,000 to 500,000 or about 8,000 to about 500,000, more preferably 9,000 to 200,000 or about 9,000 to about 200,000, and still more preferably 9,000 to 100,000 or about 9,000 to about 100,000. When the Mw is in the above range, the polyester resin is excellent in pressure fixing ability. This is for the reason that segment lengths of a certain or more length are necessary for mutual dissolution (compatibility) of separated phases in a blocked polyester resin, but it is presumed that when the segment lengths exceed a certain length, migration of the segments is difficult to occur and the rate of mutual dissolution and compatibility itself lower. Further, image strength can be improved by rapid migration to the state of phase separation. The above two kinds of polyester blocks are preferably two kinds of polyester blocks predominant in content ratios in the invention.

The difference in the SP values (solubility parameter values) of at least two kinds of the polyester blocks of the polyester resin in the invention is 0.1 to 0.7. When the difference is in the above range, mutual dissolution by pressure is efficiently caused and excellent compatibility is exhibited even with small pressure, so that pressure fixation is improved. The above two kinds of polyester blocks concerning the SP values are preferably two kinds of polyester blocks predominant in content ratios in the invention.

The SP value can be computed by the method of Fedor.

Specifically, the SP value is described in detail, for example, in Polym. Eng. Sci., Vol. 14, p. 147 (1974), and can be calculated by the following equation.

$$SP\text{Value}=\sqrt{(Ev/v)}=\sqrt{(\Sigma\Delta ei/\Sigma\Delta vi)}$$

In formula, Ev is evaporation energy (cal/mol), v is molar volume ($cm^3$/mol), Δei is evaporation energy of each atom or atomic group, and Δvi is molar volume of each atom or atomic group.

The difference in the glass transition temperature Tg (ΔTg) of at least two kinds of the polyester blocks of the polyester resin in the invention is preferably 50° C. or more or about 50° C. or more. When the difference is in the above range, pressure flowability is improved, and even when uneven pressure is caused by shifting from under high temperature high humidity environment to under low temperature low humidity environment, or with less pressure, it becomes possible to obtain higher flowability.

ΔTg is the difference in each Tg of two kinds of polyester blocks, which can be found by actual measurement or can be computed from the equation of Van Krevelen. The method of computation is described in detail in Van Krevelen, Properties of Polymers, 3rd Ed. (1990), Elsevier.

ΔTg can be controlled by the structures and molecular weights of polyester resins used as the raw materials of blocked polyester resins, i.e., monomer units of each polyester block.

The above two kinds of polyester blocks concerning Tg are preferably two kinds of polyester blocks predominant in content ratios in the invention.

A melting temperature of a crystalline resin of the invention can be found as a melting peak temperature of input compensation differential scanning calorimetry shown in JIS K-7121 when measurement is performed from room temperature or lower to 200° C. at a temperature increasing rate of 10° C. every minute. Incidentally, there are cases where crystalline resins show a plurality of melting peaks. In the invention, the maximum peak is taken as a melting temperature. Further, a glass transition temperature of a crystalline resin is a value measured in accordance with the method prescribed in ASTM D3418-82 (DSC method). Further, "crystalline" in the above "crystalline polyester resin" means to have a clear endothermic peak in differential scanning calorimetry (DSC) not a stepwise change in heat absorption. Specifically, it means the half value width of endothermic peak at the time of measurement at a temperature increasing rate of 10° C./min is within 6° C. On the other hand, resins whose half value width of endothermic peak exceeds 6° C., or resins in which a clear endothermic peak is not observed mean non-crystalline (amorphous).

For example, by the measurement of a block copolymer such as the polyester resin in the invention, endothermic peaks having two half value widths corresponding to each block exceeding 6° C. can be measured when the polyester resin has two amorphous blocks. When a polyester resin has an amorphous block and a crystalline block, an endothermic peak having a half value width exceeding 6° C. and an endothermic peak of within 6° C. can be observed. According to a crystallizing temperature, a part of endothermic peaks overlap in some cases.

It is preferred that at least one polyester block of the polyester resin in the invention is an amorphous polyester block among the polyester blocks of the polyester resin in the invention, at least one kind of two polyester blocks that are computed ΔSP value is an amorphous polyester block.

At least one polyester block of the polyester blocks of the polyester resin in the invention has Tg of preferably less than 40° C. or less than about 40° C., more preferably less than 30° C. or less than about 30° C., and still more preferably less than 20° C. or less than about 20° C.

At least one polyester block of the polyester blocks of the polyester resin in the invention has Tg of preferably 50° C. or more or about 50° C. or more, more preferably 70° C. or more or about 70° C. or more, and still more preferably 100° C. or more or about 100° C. or more.

In the two kinds of the polyester blocks of the polyester resin in the invention, when the number average molecular weight Mn of the polyester block having high Tg is taken as Mn (H), and the number average molecular weight Mn of the polyester block having low Tg is taken as Mn (L), 0.4<Mn (H)/Mn (L)<3.0 or about 0.4<Mn (H)/Mn (L)<about 3.0 is preferred to obtain efficient pressure flowability, and more preferably 0.5<Mn (H)/Mn (L)<2.0 or about 0.5<Mn (H)/Mn (L)<about 2.0.

The resin softening temperature of the polyester resin in the invention is preferably 70 to 120° C. or about 70 to about 120° C. When the softening temperature is in the above range, the flowability of powder toner and image retentivity can be properly maintained. The softening temperature can be controlled by the thermal characteristics of the monomer to be selected and the molecular weight such as Mn of the polyester blocks constituting the polyester resin.

The softening temperature in the invention is a temperature of half of a sample is flowing out with a flow tester, that is, flow tester ½ flow temperature ($T_{f1/2}$).

The softening temperature ($T_{f1/2}$) is measured with Kokashiki flow tester CFT-500 (manufactured by Shimadzu Corporation), on the condition of the pore diameter dies of 0.5 mm, pressure load of 0.98 MPa (10 kg/cm$^2$), and temperature-ascending rate of 1° C./min, and ($T_{f1/2}$) is found as the temperature corresponding to ½ of the height from flow start point to flow end point at the time when a sample of 1 cm$^3$ is melt-flowed.

The polyester resin in the invention preferably has pressure plasticity. Specifically, the temperature at the time when the viscosity becomes $10^4$ Pa·s at flow tester application pressure of 1 MPa (10 kgf/cm$^2$) is taken as T(P1), and the temperature at the time when the viscosity becomes $10^4$ Pa·s at flow tester application pressure of 30 MPa (300 kgf/cm$^2$) is taken as T(P30), it is more preferred for the polyester resin in the invention satisfies 20° C.≦T(P1)−T(P30)≦120° C. or about 20° C.≦T(P1)−T(P30)≦about 120° C. When the difference in temperature (T(P1)−T(P30)) is in the above range, pressure fixation in electrophotography is possible at ordinary temperature or lower temperature than conventional temperature.

As the monomers usable in the manufacture of the polyester resin in the invention, known monomers (polyhydric alcohol, polyvalent carboxylic acid, hydroxylcarboxylic acid, etc.) that can be used in known polyester resins are exemplified, and arbitrarily selected from these monomers. By properly selecting from these monomers, it is possible to satisfy the above constitution.

As preferred polyhydric alcohols, divalent alcohols are especially preferred.

For example, bisphenol A, hydrogenated bisphenol A, and bisphenoxyethanolfluorenes having a bisphenol structure, naphthalene dimethanol having a naphthalene structure, cyclohexanedimethanol, adamantanediol, adamantanedimethanol, norbornenediol, norbornenedimethanol, etc., having an alicyclic structure, and alkanediol having 3 to 20 carbon atoms, and derivatives thereof can be preferably exemplified.

As the derivatives of bisphenol A and bisphenoxyethanolfluorenes, alkylene oxide adducts are preferred, and ethylene oxide and propylene oxide adducts are especially preferred. As addition mol numbers, adducts in which 1 to 3 mols are added to each hydroxyl group are preferred.

As preferred polyvalent carboxylic acids, divalent carboxylic acids are especially preferred. For example, terephthalic acid, isophthalic acid, phthalic acid anhydride, naphthalenedicarboxylic acid, cyclohexanedicarboxylic acid, phenylenedicarboxylic acid, phenylenediacetic acid, phenylenedipropionic acid, cyclohexanedicarboxylic acid having an alicyclic structure, adamantanedicarboxylic acid, adamantanediacetic acid, adamantanedipropionic acid, norbornenedicarboxylic acid, norbornenediacetic acid, norbornenedipropionic acid, alkanediacid having 2 to 20 carbon atoms, and derivatives thereof are exemplified.

Hydroxycarboxylic acid can also be used. Hydroxycarboxylic acid is a compound having both a hydroxyl group and a carboxyl group in the molecule. As the hydroxycarboxylic acid, aromatic hydroxycarboxylic acid, and aliphatic hydroxycarboxylic acid are exemplified, and it is preferred to use aliphatic hydroxycarboxylic acid. Specifically, hydroxyheptanoic acid, hydroxyoctanoic acid, hydroxydecanoic acid, hydroxyundecanoic acid, lactic acid, and derivatives thereof are exemplified.

The blocked parts are synthesized from the polyester resins consisting of these polyhydric alcohols and polyvalent carboxylic acid or resins consisting of hydroxycarboxylic acid polymers. If the requisites described in the above item <1> are satisfied, block parts using three or more kinds of monomers can also be synthesized.

It is also possible to use dicarboxylic acid having an unsaturated bond and trivalent or higher polyfunctional monomers. For example, trimellitic acid, pyromellitic acid, naphthalenetricarboxylic acid, naphthalenetetracarboxylic acid, pyrenetricarboxylic acid, pyrenetetracarboxylic acid, dimethylolbutanoic acid, dimethylolpropanoic acid, and derivatives thereof can be exemplified. The use amount of these acids is preferably 10 mol % or less at the time of polyester resin polymerization.

When polyester resin that is the raw material of blocked polyester resin is polycondensed, catalysts generally used may be used including Lewis acid and Brønsted acid. As especially preferred Lewis acid catalysts, titanium compounds, tin compounds, aluminum compounds, and antimony compounds can be exemplified. As especially preferred Brønsted acid, surfactant type Brønsted acids are exemplified.

As the Brønsted acids that can be used as the catalysts, the salts of Brønsted acids are also included. Further, as the Brønsted acid, it is preferred to use sulfur acid that is oxo acid of sulfur.

Further, acids having surface activating effect may also be used. The acids having surface activating effect are acids having a chemical structure consisting of a hydrophobic group and a hydrophilic group, and at least a part of the hydrophilic group has a structure of acid comprising proton.

As the sulfur acid, inorganic sulfur acid and organic sulfur acid are exemplified. As inorganic sulfur acids, sulfuric acid, sulfurous acid, and salts of these acids are exemplified, and as organic sulfur acids, alkylsulfonic acid, arylsulfonic acid, and sulfonic acids of salts thereof, and organic sulfuric acids such as alkylsulfuric acid, arylsulfuric acid, and salts thereof are exemplified. As sulfur acids, organic sulfur acids are preferred, and organic sulfur acids having surface activating effect are more preferred.

As the organic sulfur acids having surface activating effect, e.g., alkylbenzenesulfonic acid, alkylsulfonic acid, alkyldisulfonic acid, alkylphenolsulfonic acid, alkylnaphthalenesulfonic acid, alkyltetraphosphorus sulfonic acid, alkylallylsulfonic acid, petroleum sulfonic acid, alkylbenzimidazole sulfonic acid, higher alcohol ether sulfonic acid, alkyldiphenylsulfonic acid, long chain alkylsulfuric ester, higher alcohol sulfuric ester, higher alcohol ether sulfuric ester, higher fatty acid amide alkylol sulfuric ester, higher fatty acid amide alkylated sulfuric ester, sulfated fat, sulfosuccinic ester, resin acid alcohol sulfuric acid, and salts of all of these acids are exemplified. If necessary, these acids may be used in combination of two or more kinds. Of these organic sulfur acids, sulfonic acids having an alkyl group or an aralkyl group, allenesulfonic acids having an alkyl group, sulfuric esters having an alkyl group or an aralkyl group, and salts of these acids are preferred, and the carbon atom number of the alkyl or aralkyl group is 7 to 20 is more preferred. Specifically, dodecylbenzenesulfonic acid, isopropylbenzenesulfonic acid, camphor sulfonic acid, paratoluenesulfonic acid, monobutylphenylphenolsulfuric acid, dibutylphenylphenolsulfuric acid, dodecylsulfuric acid, and naphthenyl alcohol sulfuric acid are exemplified.

As acids having surface activating effect other than the above acids, various kinds of fatty acids, sulfonated higher fatty acids, higher alkylphosphate, resin acids, naphthenic acid, and salts of all of these acids are exemplified.

Lewis acids are not especially restricted and known Lewis acids may be used. For example, tin compounds, titanium compounds, antimony compounds, beryllium compounds, strontium compounds, germanium compounds, and rare earth-containing compounds can be exemplified.

As the rare earth-containing compounds, specifically compounds containing the following elements, e.g., scandium (Sc), yttrium (Y), lanthanum (La) as lanthanoid element, cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), or lutetium (Lu) are effective, and alkylbenzenesulfonate, alkylsulfate, and compounds having a triflate structure are especially effective. Of these compounds, compounds having a triflate structure are preferred. As the triflate, a structural formula $X(OSO_2CF_3)_3$ is exemplified, wherein X represents a rare earth element, and scandium (Sc), yttrium (Y), ytterbium (Yb) and samarium (Sm) are preferred of these.

Lanthanoid triflate is described in detail in, e.g., Yuki Gosei Kagaku Kyokai-Shi (Bulletin of Organic Synthesis Chemistry Society), Vol. 53, No. 5, pp. 44-54.

The manufacturing method of a blocked polyester resin by blocking a polyester resin is not especially restricted, but a method of synthesizing at least two kinds of polyester resins in advance and bringing them into a blocking reaction, and a method of utilizing ring opening addition polymerization are exemplified. In the case of the former, for the purpose of selectively advancing the blocking reaction, a method of adjusting the terminal of each polyester resin and synthesizing a polyester resin with carboxylic acid terminal alone and a polyester resin with alcohol terminal alone is exemplified. It is also possible to design to introduce a monomer functional groups low in reactivity at a low temperature and specific functional groups alone are reacted at the time of blocking at a low temperature.

Two or more kinds of polyester blocks in the polyester resin in the invention are preferably bonded by ester bonding to each other.

The blocking structure in the polyester resin in the invention is not especially restricted, but AB type is preferred. In the case of AB type, when pressure is applied, free flowability becomes possible and so preferred.

It is preferred to use Brønsted acid catalyst in blocking at least two kinds of polyester resins.

As the Brønsted acid catalyst, it is preferred to use sulfur acid. Since Brønsted acid catalyst has activity at relatively low temperature, an ester exchange reaction and decomposition of polyester by heat are restrained.

As the sulfur acids, sulfuric acid, alkylsulfonic acid, alkylbenzenesulfonic acid, alkoxybenzenesulfonic acid as described above can be exemplified, and the compounds represented by the following formula (S-1), (S-2) or (S-3) are especially preferred.

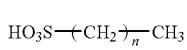
(S-1)

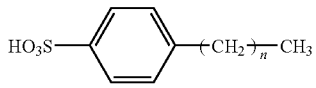
(S-2)

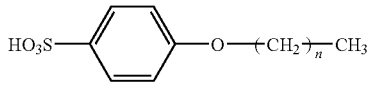
(S-3)

In formulae (S-1) to (S-3), n represents an integer of 7 or more, and preferably an integer of 7 to 30.

(Manufacturing Method of Polyester Resin for Electrostatic Image Developing Toner)

The manufacturing method of the polyester resin for the electrostatic image developing toner in the invention (hereinafter referred to as "the manufacturing method of the polyester resin in the invention in some cases") is preferably a method including a process of manufacturing polyester resin A (hereinafter also referred to as "polycondensation process A"), a process of manufacturing polyester resin B (hereinafter also referred to as "polycondensation process B"), and a blocking process of reacting at least polyester resin A and polyester resin B to manufacture a polyester resin having at least polyester block A derived from polyester resin A and polyester block B derived from polyester resin B.

As the polyester resin in the invention, for example, when a polyester resin having three or more kinds of polyester blocks is manufactured, the above manufacturing method further includes a process of manufacturing polyester resin C, and a blocking process of reacting at least polyester resin A, polyester resin B, and polyester resin C to manufacture a polyester resin having at least polyester block A derived from polyester resin A, polyester block B derived from polyester resin B, and polyester block C derived from polyester resin C is exemplified.

As the manufacturing of the polyester resin of the invention, a method including a process of manufacturing polyester resin A, a process of manufacturing polyester resin B, and a blocking process of reacting polyester resin A and polyester resin B to manufacture a polyester resin having at least polyester block A derived from polyester resin A and polyester block B derived from polyester resin B is especially preferred.

The manufacturing method of the polyester resin of the invention may use a polycondensation catalyst in the polycondensation processes such as polycondensation process A and polycondensation process B, and the blocking process. From the points of reactivity and capable of simplifying the manufacturing processes, it is especially preferred to use a sulfur acid as the polycondensation catalyst.

The use amount of the polycondensation catalyst in the polycondensation processes such as polycondensation process A and polycondensation process B is preferably 0.01 to 5 mol % or about 0.01 to about 5 mol % on the basis of the entire amount of the polycondensation monomers, and more preferably 0.05 to 2 mol % or about 0.05 to about 2 mol %. When the sum amount is in the above range, polycondensation can properly advance without causing decomposition of the polymers.

The use amount of the polycondensation catalyst in the blocking process is preferably 0.01 to 5 wt % or about 0.01 to about 5 wt % based on all the weight of the resins used as the raw materials, and more preferably 0.1 to 2 wt % or about 0.1 to about 2 wt %. When the use amount is in the above range, blocking can properly advance without causing decomposition of the polymers.

Polycondensation reaction in the polycondensation process and blocking reaction in the blocking process can be carried out by general polycondensation method such as underwater polymerization, solution polymerization, interfacial polymerization such as bulk polymerization, emulsion polymerization and suspension polymerization. Further, the reactions can be performed under atmospheric pressure, and when the increase of molecular weight of the polyester resin is aiming at, general conditions such as reduction of pressure and under nitrogen current can be widely used.

In the above polycondensation process and/or the blocking process, polycondensation reaction and blocking reaction are preferably performed under reduced pressure with heating.

The reaction temperature of the polycondensation process for synthesizing each block is not particularly restricted, and the temperature can be set up according the catalysts and monomers to be used. Specifically preferably 100 to 280° C., and more preferably 130 to 260° C.

The reaction temperature of the blocking process is preferably 70 to 180° C., more preferably 100 to 170° C., still more preferably 120 to 170° C., and especially preferably 120 to 160° C.

The reaction time may be arbitrarily selected according to the reaction temperature and the like, and preferably 0.5 to 72 hours, more preferably 1 to 48 hours, and still more preferably 2 to 42 hours.

The polycondensation reaction in the polycondensation process and the blocking reaction in the blocking process may be performed in an aqueous medium or an organic solvent, but it is preferred to perform bulk polymerization not using an aqueous medium or an organic solvent.

As the aqueous media that can be used in the invention, water such as distilled water and ion exchange water, and alcohols such as methanol and methanol are exemplified. Of these media, ethanol, methanol and water are preferred. In the case of water, distilled water and ion exchange water are preferred. These media may be used by one kind alone, or two or more kinds of media may be used in combination.

The aqueous medium may contain water-miscible organic solvent. As the water-miscible organic solvents, e.g., acetone and acetic acid are exemplified.

As the specific examples of the organic solvents such can be used in the invention, hydrocarbon solvents, e.g., toluene, xylene, mesitylene, etc.; halogen solvents, e.g., chlorobenzene, bromobenzene, iodobenzene, dichlorobenzene, 1,1,2,2-tetrachloroethane, p-chlorotoluene, etc.; ketone solvents, e.g., 3-hexanone, acetophenone, benzophenone, etc.; ether solvents, e.g., dibutyl ether, anisole, phenetole, o-dimethoxybenzene, p-dimethoxybenzene, 3-methoxytoluene, dibenzyl ether, benzyl phenyl ether, methoxynaphthalene, tetrahydrofuran, etc.; thioether solvents, e.g., phenyl sulfide, thioanisole, etc.; ester solvents, e.g., ethyl acetate, butyl acetate, benzyl acetate, methyl benzoate, methyl phthalate, ethyl phthalate, cellosolve acetate, etc.; and diphenyl ether solvents, e.g., diphenyl ether, and alkyl-substituted diphenyl ether, e.g., 4-methylphenyl ether, 3-methylphenyl ether, 3-phenoxytoluene, etc., and halogen-substituted diphenyl ether, e.g., 4-bromophenyl ether, 4-chlorophenyl ether, 4-bromodiphenyl ether, 4-methyl-4'-bromodiphenyl ether, etc., and alkoxy-substituted diphenyl ether, e.g., 4-methoxydiphenyl ether, 4-methoxyphenyl ether, 3-methoxyphenyl ether, 4-methyl-4'-methoxydiphenyl ether, etc., and cyclic diphenyl ether, e.g., dibenzofuran, xanthene, etc., are exemplified, and these solvents may be used as mixture. Solvents easily separable from water are preferred. In particular, for obtaining polyesters having high average molecular weight, ester solvents, ether solvents, and diphenyl ether solvents are more preferred, and alkyl aryl ether solvents and ester solvents are especially preferred.

Further, for obtaining binder resins having high average molecular weight in the invention, a dehydrating agent and a de-monomer agent may be added. As the specific examples of the dehydrating agents and de-monomer agents, molecular sieves such as Molecular Sieve 3A, Molecular Sieve 4A, Molecular Sieve 5A, and Molecular Sieve 13X, hydrides, such as metal hydrides, e.g., silica gel, calcium chloride, calcium sulfate, diphosphorus pentoxide, concentrated sulfuric acid, magnesium perchlorate, barium oxide, calcium oxide, potassium hydroxide, sodium hydroxide, and alkali metals, e.g., sodium, etc., are exemplified. Of these, molecular sieves are preferred for easiness of handling and reproduction.

The polyester resins for use in the manufacture of blocked polyester resins can be manufactured by polycondensation with polycondensate monomers other than described above so long as the characteristics of the resins are not damaged. For example, monovalent carboxylic acids and monovalent alcohols are exemplified. Since these monofunctional monomers function to cap the terminals of the polyester resins, they can control the property of the polyester resins by effective terminal modification. The monofunctional monomers may be used from the initial stage of polymerization or may be added in the middle of reaction.

In the invention, as the polycondensation process, a polymerization reaction of the above monomers and previously manufactured prepolymers may be included. The prepolymers are not especially limited so long as they are polymers capable of being fused or homogeneously mixed with the monomers.

Further, the polyester resins in the invention may contain a homopolymer using one kind of the above dicarboxylic acid component and diol component respectively, a copolymer combining two or more monomers including the above monomers, or may have a mixture of these compounds, a graft polymer, or a partially branched crosslinked structure.

(Electrostatic Image Developing Toner)

The electrostatic image developing toner in the invention (hereinafter also referred to as merely "toner" in some cases) is a toner containing the polyester resin for the electrostatic image developing toner of the invention.

The electrostatic image developing toner in the invention can be manufactured according to known methods.

Specifically, the toner can be manufactured by a kneading and grinding method, and also can be manufactured by chemical manufacturing methods (what is called an aggregation-coalescence method, a polyester stretching method, a suspension polymerization method, an emulsion polymerization method, a dispersion polymerization method, a dissolution suspension method, etc.).

The electrostatic image developing toner in the invention may be manufactured by any of these methods, and contains the polyester resin of the invention as the binder resin.

Of the above methods, the electrostatic image developing toner in the invention is preferably a toner manufactured by a chemical manufacturing method, and more preferably an electrostatic image developing toner manufactured by the aggregation-coalescence method.

The content of the polyester resin of the invention in the electrostatic image developing toner in the invention is preferably 10 to 90 wt % on the basis of the total weight of the toner, more preferably 30 to 85 wt %, and still more preferably 50 to 80 wt %.

If necessary, known additives may be added to the electrostatic image developing toner in the invention in combination of one or more in the range not affecting the effect of the invention. For example, a charge controlling agent, a releasing agent, a flame retardant, a coloring agent, a brightener, a waterproof agent, a water repellent, an inorganic filler (a surface modifier), an antioxidant, a plasticizer, a surfactant, a dispersant, a lubricant, a filler, an extender pigment, etc., are exemplified. These additives may be blended in any process of the manufacturing processes of the electrostatic image developing toner.

As the examples of internal additives, as the charge controlling agent, generally used various charge controlling agent such as quaternary ammonium compounds and Nigrosine compounds can be used, but from the points of stability in manufacturing time and reduction of waste solution, materials hardly soluble in water are preferably used.

As the examples of the releasing agents, low molecular weight polyolefins, e.g., polyethylene, polypropylene, polybutene, silicones showing a softening temperature by heating; fatty acid amides, e.g., oleic acid amide, erucic acid amide, ricinoleic acid amide, stearic acid amide, etc.; ester waxes, vegetable waxes, e.g., carnauba wax, rice wax, candelilla wax, Japan wax, jojoba oil, etc.; animal waxes, e.g. bees wax, etc.; mineral and petroleum waxes, e.g., montan wax, ozokerite, ceresine, paraffin wax, microcrystalline wax, Fischer-Tropsch wax, etc.; and modifies products of them can be used.

The content of the releasing agent is preferably 5 to 30 wt % or about 5 to about 30 wt % on the basis of the total weight of the solids content constituting the toner, more preferably 5 to 25 wt % or about 5 to about 25 wt %, and still more preferably 10 to 15 wt % or about 10 to about 15 wt %. When the content is in the above range, the releasing property of the fixed image can be sufficiently ensured.

As the examples of the flame retardants and flame retardant assistants, already generally used bromine series flame retardants, antimony trioxide, magnesium hydroxide, aluminum hydroxide and ammonium polyphosphate are exemplified but the invention is not restricted thereto.

As the coloring agents, known coloring agents can be used.

For example, carbon blacks, e.g., furnace black, channel black, acetylene black, thermal black, etc.; inorganic pigments, e.g., iron oxide red, Berlin blue, titanium oxide, etc.; azo pigments, e.g., Fast Yellow, Disazo Yellow, Pyrazolone Red, chelate red, Brilliant Carmine, Para Brown, etc.; phthalocyanine pigments, e.g., Copper Phthalocyanine, nonmetal phthalocyanine, etc.; condensed polycyclic pigments, e.g., flavanthrone yellow, dibromoanthrone orange, perylene red, Quinacridone Red, Dioxazine Violet, etc.; and various kinds of pigments, e.g., Chrome Yellow, Hansa Yellow, Benzidine Yellow, Indanthrene Yellow, Quinoline Yellow, Permanent Orange GTR, Pyrazolone Orange, Vulcan Orange, Watchung Red, Permanent Red, Du Pont Oil Red, Lithol Red, Rhodamine B Lake, Lake Red C, Rose Bengal, Aniline Blue, Ultramarine Blue, Chalcooil Blue, Methylene Blue Chloride, Phthalocyanine Blue, Phthalocyanine Green, Malachite Green Oxalate, C.I. Pigment Red 48:1, C.I. Pigment Red 122, C.I. Pigment Red 57:1, C.I. Pigment Yellow 12, C.I. Pigment Yellow 97, C.I. Pigment Yellow 17, C.I. Pigment Blue 15:1, C.I. Pigment Blue 15:3 are exemplified, and these coloring agents may be used by one kind alone, or two or more in combination.

The content of the coloring agent is preferably 0.1 to 20 weight parts per 100 weight parts of the toner, and especially preferably 0.5 to 10 weight parts.

Similarly to general toners, after drying, inorganic particles, e.g., silica, alumina, titania, and calcium carbonate, and resin particles, e.g., vinyl resins, polyester, and silicone may be used by adding to the surface in a dry state by applying shear force, as flowability assistants and cleaning assistants.

As the examples of the surfactants that can be used in the invention, anionic surfactants, e.g., sulfuric esters, sulfonic esters, phosphoric esters, soaps, etc.; cationic surfactants, e.g., amine salt type, and quaternary ammonium type, etc.; and nonionic surfactants, e.g., polyethylene glycol, alkylphenol-ethylene oxide adducts, polyhydric alcohols, etc., are exemplified, and it is effective to use them in combination. As a means for dispersion, a rotating shearing type homogenizer and a ball mill, a sand mill, a Dyno-mill, each of which has media can be used.

The electrostatic image developing toner in the invention preferably has a volume average particle size ($D_{50}$) of 3.0 to 20.0 μm or about 3.0 to about 20.0 μm, and more preferably 3.0 to 9.0 μm or about 3.0 to about 9.0 μm. When ($D_{50}$) is 3.0 μm or more, the toner has appropriate adhesion force, and shows excellent developability. Further, when ($D_{50}$) is 20.0 μm or less, excellent image resolution can be obtained. The volume average particle size ($D_{50}$) can be measured with a laser diffraction type particle size distribution measuring meter.

The electrostatic image developing toner in the invention preferably has a volume average particle size distribution ($GSD_v$) of 1.4 or less or about 1.4 or less. In particular, in the case of toners manufactured by chemical methods, ($GSD_v$) is more preferably 1.3 or less or about 1.3 or less. As the particle size distribution, by using the cumulative distributions of $D_{16}$ and $D_{84}$, the volume average particle size distribution ($GSD_v$) or the number average particle size distribution can be easily used as follows.

$$GSD_v=(D_{84}/D_{16})^{0.5}$$

When $GSD_v$ is 1.4 or less, the particle size is uniform, the fixing property is excellent, and an apparatus failure due to a fixing failure scarcely occurs, and further, pollution in an apparatus due to the splash of the toner and the deterioration of the developer also scarcely occur, thus it is preferred. The volume average particle size distribution ($GSD_v$) can be measured with a laser diffraction type particle size distribution measuring meter.

Similarly, when the toner of the invention is manufactured by a chemical method, the shape factor SF1 is preferably 100 to 140 or about 100 to about 140 from the aspect of image-forming property, and more preferably 110 to 135 or about 110 to about 135. The shape factor SF1 is computed as follows.

$$SF1 = \frac{(ML)^2}{A} \times \frac{\pi}{4} \times 100$$

In the equation, ML represents the absolute maximum length of the particle, and A represents the projected area of the particle.

SF1 is expressed as a numerical value by taking mainly microphotograph images or scanning electron microphotograph images into LUZEX image analyzer and analyzing.

It is preferred that the manufacturing method of the electrostatic image developing toner in the invention include at least a process of obtaining resin particle dispersion by emulsion-dispersing the polyester resin in the invention in an aqueous medium, a process of obtaining aggregated particles by aggregating the resin particles in the dispersion containing the resin particle dispersion (hereinafter also referred to as "the aggregation process"), and a process of fusing the aggregated particles by heating (hereinafter also referred to as "the fusion process").

According to the manufacturing method of the electrostatic image developing toner in the invention, resin particle dispersion containing the polyester resin of the invention is mixed with coloring agent particle dispersion and releasing agent particle dispersion, an aggregating agent is added and hetero aggregation is caused, by which aggregated particles of the toner size are formed. After that, the aggregated particles are heated at a temperature higher than the glass transition temperature or higher than the melting temperature of the resin to fuse and coalesce the aggregated particles, and the electrostatic image developing toner in the invention is obtained through washing and drying. As the shapes of the toners, from amorphous to spherical are preferably used. As the aggregating agent, inorganic salts and divalent or higher metal salts are preferably used in addition to surfactants. Metal salts are especially preferred from the points of the control of aggregating property and charging characteristics of the toner.

In the aggregation process, it is also possible to aggregate the resin particle dispersion in which the polyester resin in the invention is dispersed and the coloring agent particle dispersion in advance to form first aggregated particles, add the resin particle dispersion or other resin particle dispersion thereto and form second shell layers on the surfaces of the first particles. In this exemplary embodiment, the coloring agent particle dispersion is separately prepared but the coloring agent may be previously blended with the resin particles in the resin particle dispersion.

In the invention, the forming method of the aggregated particles is not especially restricted, and a conventional aggregation method used in an emulsion polymerization aggregation method of an electrostatic image developing toner, e.g., a method of lowering stability of en emulsion by temperature increase, a pH change, and addition of salt, and stirring the dispersion with a disperser and the like is used. Further, after aggregation treatment, for the purpose of restraining bleeding of the coloring agent from the surfaces of particles, the surfaces of particles may be crosslinked by performing heat treatment and the like. Further, the used surfactant may be removed by washing with water, acid, or alkali, if necessary.

A charge controlling agent used in this kind of toner may be used in the manufacturing method of the electrostatic image developing toner in the invention, if necessary. In such a case, the charge controlling agent may be made as an aqueous dispersion at the time of initiation of the manufacture of the monomer particle emulsion, or polymerization initiating time, or initiating time of the aggregation of the resin particles.

The addition amount of the charge controlling agent is preferably 1 to 25 weight parts per 100 weight parts of the binder resin in the toner, and preferably 5 to 15 weight parts.

As the charge controlling agents, known compounds can be used, for example, positive charge controlling agents, e.g., Nigrosine dyes, quaternary ammonium salt compounds, triphenylmethane compounds, imidazole compounds, and polyamine resins, azo dyes containing metals, e.g., chromium, cobalt, aluminum, etc., metal salt and metal complex such as chromium, zinc, aluminum, etc., of hydroxycarboxylic acid, e.g., salicylic acid, alkylsalicylic acid, benzilic acid, etc., and negative charge controlling agents, e.g., amide compounds, phenol compounds, naphthol compounds, phenolamide compounds, etc., are exemplified.

Further, besides the resin particle dispersion of the polyester resin of the invention, other resin particle dispersions of polycondensed resins, addition polymerization resin particle dispersions manufactured by conventionally known emulsion polymerization and the like can also be used together. The median size ($D_{50}$) of the resin particles in the addition polymerization resin particle dispersions is preferably 0.1 μm or more and 2.0 μm or less.

As the addition polymerizable monomers for manufacturing these addition polymerization resin particle dispersions, known addition polymerizable monomers can be used. In the case of addition polymerizable monomers, resin particle dispersions can be obtained by emulsion polymerization with ionic surfactants and the like. In the case of other resins, resin particle dispersions can be obtained, if the resins are dissolved in a solvent that is oily and solubility in water is relatively low, by dissolving the resins in the solvent, dispersing in an aqueous medium as particle state with an ionic surfactant and a polymer electrolyte by means of a disperser such as a homogenizer, and after that, by heating or reducing pressure to evaporate the solvent. The above polymerization initiators and chain transfer agents can also be used at the time of polymerization of the addition polymerizable monomers.

(Electrostatic Image Developer)

The electrostatic image developing toner in the invention can be used as the electrostatic image developer.

The electrostatic image developer in the invention is not especially restricted except for containing the electrostatic image developing toner in the invention, and optional component composition can be taken according to the purpose. When the electrostatic image developing toner is used alone, it is prepared as one-component electrostatic image developer, and when used in combination with a carrier, it is prepared as two-component electrostatic image developer.

As one-component developer, a developing method of forming a charged toner by triboelectrification of the developer with a developing sleeve or a charging member and developing according to the electrostatic latent image may also be used.

The carrier is not especially restricted, but generally resin-covered carrier with magnetic particles, e.g., iron powder, ferrite, iron oxide powder, nickel, or the like, as a core material, and covered with a resin-covering layer, such as resin, e.g., styrene resin, vinyl resin, ethylene resin, rosin resin, polyester resin, melamine resin, etc., or wax, e.g., stearic acid or the like; and magnetic powder dispersion type carrier comprising a binder resin having dispersed therein magnetic powder are exemplified. Of these carriers, the resin-covered carrier is especially preferred in the point of capable of controlling the charging ability of the toner and the resistance of the carrier at large with the constitution of the resin-covering layer.

The mixing ratio of the electrostatic image developing toner and carrier of the invention in two-component electrostatic image developer is preferably 2 to 10 weight parts of the electrostatic image developing toner to 100 weight parts of the carrier. The manufacturing method of the developer is not especially restricted, and a method of mixing the toner and a carrier with a V blender and the like is exemplified.

(Image-Forming Method)

The electrostatic image developer (electrostatic image developing toner) can be used in the image-forming method of an ordinary electrostatic image developing system (an electrophotographic system).

The image-forming method of the invention preferably comprises a latent image-forming process of forming an electrostatic latent image on the surface of an electrostatic latent image holding member, a developing process of forming a toner image by developing the electrostatic latent image formed on the surface of the latent image holding member with a developer containing a toner, a transfer process of transferring the toner image formed on the surface of the latent image holding member to the surface of a transfer-receiving material, and a fixing process of pressure fixing the toner image transferred to the surface of the transfer-receiving material. Further, a cleaning process may be included image-forming method of the invention, if necessary.

Each of the above processes is an ordinary process in itself and disclosed, e.g., in JP-A-56-40868 and JP-A-49-91231. The image-forming method of the invention can be carried out by a known image-forming apparatus such as a copier and a facsimile.

The latent image-forming process is a process for forming an electrostatic latent image on the surface of a latent image holding member.

The developing process is a process for forming a toner image by developing the electrostatic latent image with a developer layer on the developer holding member. The developer layer is not especially restricted so long as it contains the electrostatic image developer in the invention containing the electrostatic image developing toner in the invention.

The transfer process is a process for transferring the toner image to the transfer-receiving material.

The fixing process is a process for fixing the toner image transferred to the surface of the transfer-receiving material transferred to a recording-receiving material such as paper by applying pressure or by heating and application of pressure to form a duplicating image.

The pressure at the time of fixation is preferably 5 kgf/cm$^2$ or more and 500 kgf/cm$^2$ or less, and more preferably 5 kgf/cm$^2$ or more and 300 kgf/cm$^2$. When the fixing pressure is in the above range, sufficient fixation can be ensured, and excellent image strength can be obtained. In addition, reduction of image quality characteristics due to paper wrinkle and paper stretching can be restrained.

Fixing pressure is preferably 5 to 300 kgf/cm$^2$, more preferably 10 to 200 kgf/cm$^2$, and still more preferably 20 to 100 kgf/cm$^2$. When the fixing pressure is in this range, fixing property and image characteristics can be compatible.

In fixing pressure, when an image is fixed by heating pressure, heating temperature is preferably 50 to 120° C., and more preferably 60 to 100° C.

Pressure distribution between fixing roll and pressure roll can be measured by a commercially available pressure distribution measuring sensor, specifically it can be measured with a pressure measuring system between rollers (manufactured by Kamata Industry Co., Ltd.). In the invention, fixing pressure means the maximum value of the change in pressure from the inlet to the outlet of the fixing nip in the paper progressing direction. This is the process of fixing the toner image transferred to the recording-receiving material such as recording paper to form a duplicating image.

The cleaning process is a process for removing the electrostatic image developer remaining on the latent image holding member. In the image-forming method in the invention, an embodiment of further including a recycling process is preferred.

The recycling process is a process to convey the electrostatic image developing toner collected in the cleaning process to the developer layer. This image-forming method of the embodiment including the recycling process can be carried out by a copier of a toner-recycling system type and an image-forming apparatus such as a facsimile. This method can also be applied to a recycling system of an embodiment of collecting a toner simultaneously with development by omitting a cleaning process.

The objecting duplicating product (printed matter and the like) is obtained through such a series of treating processes.

(Image-Forming Apparatus)

The image-forming apparatus in the invention has a latent image holding member, a charging unit for charging the latent image holding member, an exposure unit for forming an electrostatic latent image on the surface of the latent image holding member by exposing the charged latent image holding member, a developing unit of developing the electrostatic latent image with a developer containing a toner to form a toner image, a transfer unit of transferring the toner image from the latent image holding member to the surface of a transfer-receiving material, and a fixing unit of pressure fixing the toner image transferred to the surface of the transfer-receiving material. In the transfer unit, two or more times of transfer may be performed by using an intermediate transfer body.

As the latent image holding member and each unit, the structure described in the above image-forming method can be preferably used.

As the above each unit, known units in image-forming apparatus can be used. The image-forming apparatus for use in the invention may include units and apparatus other than the structure described above. Further, the image-forming apparatus for use in the invention may perform a plurality of units among the units described above at the same time.

(Toner Cartridge and Process Cartridge)

The toner cartridge in the invention is a toner cartridge housing at least the electrostatic image developing toner of the invention.

The toner cartridge in the invention may contain the electrostatic image developing toner of the invention as the electrostatic image developer.

Further, the process cartridge in the invention is a process cartridge including at least one selected from the group consisting of a latent image holding member, a charging unit for charging the surface of the latent image holding member, a developing unit for developing an electrostatic latent image with a developer containing a toner to form a toner image, and a cleaning unit for removing the toner remaining on the surface of the latent image holding member, and housing at least the electrostatic image developing toner of the invention or the electrostatic image developer of the invention.

The toner cartridge in the invention is preferably attachable to and detachable from an image-forming apparatus. That is, the toner cartridge of the invention housing the toner of the invention is preferably used in an image-forming apparatus having a structure of capable of attachable and detachable a toner cartridge.

The toner cartridge may be a cartridge for housing the toner and the carrier, alternatively the cartridge may be constituted separately as a cartridge for housing the toner alone and a cartridge for housing the carrier alone.

The process cartridge in the invention is preferably attachable to and detachable from the image-forming apparatus.

Further, the process cartridge in the invention may include other members such as a destaticizing unit and the like, if necessary.

Toner cartridges and process cartridges having known structures may be adopted and, for example, JP-A-2008-209489 and JP-A-2008-233736 can be referred to.

Example

The invention will be described specifically with reference to examples more, but the invention is by no means restricted to the examples alone.

In the examples "parts" and "%" mean "weight parts" and "wt %" respectively unless otherwise indicated.

[Measuring Method]

<Measuring Method of Volume Average Particle Size (The Case where Particle Size to be Used is 2 μm or More)>

When the particle size to be used is 2 μm or more, the volume average particle size of the particles is measured with Coulter Multisizer II (manufactured by Beckmann-Coulter). As the electrolyte, ISOTON-II (manufactured by Beckmann-Coulter) is used.

As a measuring method, 0.5 mg of a measuring sample is put in 2 ml of a 5% aqueous solution of a surfactant (sodium dodecylbenzenesulfonate) as a dispersant, which is poured into 100 ml of the electrolyte. The electrolyte in which the sample is suspended is subjected to dispersing treatment for about 1 minute with an ultrasonic wave disperser, and the particle size distribution of particles in the range of the particle size of 2.0 to 60 μm is measured with Coulter Multisizer II using apertures of the diameter of 100 μm. The number of measured particles is 50,000.

The obtained particle size distribution data are plotted relative to the divided particle size ranges (channels) to draw the volume cumulative distribution from the particles having a smaller particle size, and the particle size of cumulative 50% is defined as volume average particle size.

<Measuring Method of Volume Average Particle Size (The Case where Particle Size to be Used is Less Than 2 μm)>

When the particle size to be used is less than 2 μm, the volume average particle size of the particles is measured with a laser diffraction type particle size distribution measuring meter (LS13320, manufactured by Beckmann-Coulter).

As a measuring method, the dispersion of the sample is adjusted with ion exchange so as to reach a solid content rate of about 10%, which is put in cells, and measurement is performed when the scattering strength is sufficient to be measured.

The obtained volume average particle size of every channel is accumulated from the particles having a smaller particle size, and the particle size of cumulative 50% is defined as volume average particle size.

<Measuring Methods of Glass Transition Temperature (Tg) and Melting Temperature>

Measurement is performed with a differential scanning calorimeter (DSC). Specifically, DSC50 manufactured by Shimadzu Corporation is used in measurement.

Sample: 3-15 mg, preferably 5 to 10 mg is used.

Measuring method: The sample is put in an aluminum pan, and a vacant aluminum pan is used as the reference.

Temperature curve: Temperature up I (20 to 180° C., temperature up rate: 10° C./min)

Temperature down I (180 to 10° C., temperature down rate: 10° C./min)

Temperature up II (10 to 180° C., temperature up rate: 10° C./min)

In the above temperature curve, glass transition temperature is measured from the endothermic curve measured by temperature up II. Glass transition temperature is a temperature of the intersection of the tangential line of the curve and the base line at the minimum temperature of the temperatures showing the maximum of the differential value of the curve of endothermic peak. The melting temperature is the temperature measured of the maximum of melt absorption peak in temperature up I.

<Measuring Methods of Weight Average Molecular Weight Mw and Number Average Molecular Weight Mn>

The values of weight average molecular weight Mw and number average molecular weight Mn are measured according to the following condition by gel permeation chromatography (GPC) A solvent (tetrahydrofuran) is flowed at a flow rate of 1.2 ml/min at a temperature of 40° C., and a tetrahydrofuran sample solution of concentration of 0.2 g/20 ml as sample weight of 3 mg is poured and measurement is performed. In molecular weight measurement of the sample, measuring condition is selected so that the molecular weight of the sample is included in the range making a straight line in count number with the logarithms of the molecular weight of calibration curves produced by several kinds of monodispersed polystyrene standard samples.

The reliability of the results of measurement can be confirmed by the fact that NBS706 polystyrene standard sample shows:

Weight average molecular weight $Mw=28.8\times10^4$

Number average molecular weight $Mn=13.7\times10^4$

As the columns of GPC, TSK-GEL, GMH (manufactured by TOSOH CORPORATION) are used.

The solvents and temperatures are changed to proper conditions according to test samples.

When resin particle dispersion is manufactured by using aliphatic polyester resin as the polyester resin, and resin obtained by polymerization of a monomer containing an aromatic group as the addition polymerization type resin, in analysis of the molecular weights of both resins with GPC, the molecular weight of each resin can be analyzed by attaching later an instrument separating UV and RI as the detector.

<Measurement and Analyzing Method of NMR>

Resin is dissolved in heavy THF and the structure is identified with nuclear magnetic resonance (NMR) (JMN-AL400, manufactured by Nihon Denshi Co., Ltd.).

(Synthesis of Polyester Resin (1))

Terephthalic acid (TPA)/ethylene oxide 2 mol % adduct of bisphenol A (BPA-2EO) in proportion of 48/52 mol % is put in a polycondensation reactor, and the temperature is raised to 220° C. under nitrogen current. After confirmation of dissolution of the raw material, stirring is started at 40 rpm, and 0.2 mol % of dibutyltin oxide is added thereto. With maintaining the temperature at 220° C., pressure is gradually reduced and polymerization is continued for 8 hours at less than 100 hPa.

The obtained polyester resin (1) is a resin having a molecular weight Mw of 18,000 and Tg of 103° C. (actual measurement by DSC).

(Synthesis of Polyester Resin (2))

Polymerization is performed in the same manner as in the synthesis of polyester resin (1) with TPA/BPA-2EO in proportion of 48/52 mol %, and with 0.2 mol % of dibutyltin oxide at 230° C. for 8.5 hours.

(Synthesis of Polyester Resin (6))

Polymerization is performed with CHDA/BPA-2EO in proportion of 48/52 mol %, and with 0.2 mol % of dibutyltin oxide at 180° C. for 13 hours.

The obtained polyester resin (6) is a resin having a molecular weight Mw of 15,000 and Tg of 55° C. (computed from the equation of Van Kravelene).

(Synthesis of Polyester Resin (7))

Polymerization is performed with octadecanedicarboxylic acid (CC16)/dodecanediol (C12) in proportion of 48/52 mol %, and with 0.2 mol % of straight chain dodecylbenzenesulfonic acid at 160° C. for 12 hours.

The obtained polyester resin (7) is a resin having a molecular weight Mw of 15,000 and Tg of −63° C. (computed from the equation of Van Kravelene).

(Synthesis of Polyester Resin (8))

Polymerization is performed with TPA/1,4-butanediol (C4) in proportion of 48/52 mol %, and with 0.2 mol % of dibutyltin oxide at 230° C. for 9 hours.

The obtained polyester resin (8) is a resin having a molecular weight Mw of 13,000 and Tg of 79° C. (actual measurement by DSC).

The values of physical properties of polyester resins (1) to (8) are shown together in Table 1 below. Polyester resins (4) and (7) are crystalline resins and other polyester resins (1) to (3), (5), (6) and (8) are amorphous resins.

TABLE 1

| | Polyester Resin (1) | Polyester Resin (2) | Polyester Resin (3) | Polyester Resin (4) | Polyester Resin (5) | Polyester Resin (6) | Polyester Resin (7) | Polyester Resin (8) |
|---|---|---|---|---|---|---|---|---|
| Composition | TPA/BPA-2EO | TPA/BPA-2EO | TPA/BPA-2PO/ BPA-2EO | PDAA/C6 | CHDA/ C7 | CHDA/ BPA-2EO | CC16/ C12 | TPA/C4 |
| Mw | 18,000 | 9,700 | 10,500 | 14,000 | 20,000 | 15,000 | 15,000 | 13,000 |
| Mn | 8,000 | 4,600 | 5,200 | 6,800 | 8,800 | 6,500 | 7,500 | 5,900 |
| Tg (° C.) | 103 | 101 | 109 | −20 | −23 | 55 | −63 | 79 |

The obtained polyester resin (2) is a resin having a molecular weight Mw of 9,700 and Tg of 101° C. (actual measurement by DSC).

(Synthesis of Polyester Resin (3))

Polymerization is performed in the same manner as in the manufacture of polyester resin (1) with TPA/propylene oxide 2 mol adduct of bisphenol A (BPA-2PO)/BPA-2EO in proportion of 48/20/32 mol %, and with 0.2 mol % of tetrabutoxy titanate at 240° C. for 11 hours.

The obtained polyester resin (3) is a resin having a molecular weight Mw of 10,500 and Tg of 109° C. (actual measurement by DSC).

(Synthesis of Polyester Resin (4))

Polymerization is performed with 1,4-phenylenediacetic acid (PDAA)/1,6-hexanediol (C6) in proportion of 48/52 mol %, and with 0.2 mol % of dibutyltin oxide at 180° C. for 18 hours.

The obtained polyester resin (4) is a resin having a molecular weight Mw of 14,000 and Tg of −20° C. (computed from the equation of Van Kravelene).

(Synthesis of Polyester Resin (5))

Polymerization is performed with CHDA (1,4-Cyclohexanedicarboxylic acid)/1,7-heptanediol (C7) in proportion of 48/52 mol %, and with 0.2 mol % of dibutyltin oxide at 180° C. for 13 hours.

The obtained polyester resin (5) is a resin having a molecular weight Mw of 20,000 and Tg of −23° C. (computed from the equation of Van Kravelene).

Blocked polyester resin is synthesized by using each of the above polyester resins.

(Synthesis of Blocked Polyester Resin 1)

Polyester resin (1) (45 weight parts) and 50 weight parts of polyester resin (5) are put in a stainless steel polymerizer, and the temperature is raised to 140° C. while substituting nitrogen. After the temperature has reached 140° C. and the resins are melted, stirring is started at 35 rpm, and 0.6 weight parts of dodecylbenzenesulfonic acid catalyst is added. Pressure is reduced and stirring is continued for 8 hours to obtain blocked polyester resin 1.

The obtained blocked polyester resin 1 is a resin having Mw of 41,000, and it has been confirmed from $^{1}H$ NMR analysis that peaks showing the functional groups ascribing to polyester resins (1) and (5) used as the raw materials have disappeared and a peak showing the formation of new block bonding has appeared.

Ester concentration of blocked polyester resin 1 is calculated.

The number of ester bonds in one unit of TPA/BPA-2EO is 2, and atom number is 33. On the other hand, the number of ester bonds in CHDA/C7 unit is 2 and atom number is 19.

The molar ratio of a blocked resin is found by comparing the ratio of the molecular weight of the unit and the weight of the charged amount.

In the case of the blocked resin, the ratio of the degree of polymerization in the resin of TPA/BPA-2EO and the degree of polymerization of CHDA/C7 is 50 weight parts/unit molecular weight of TPA/BPA-2EO:50 weight parts/unit molecular weight of CHDA/C7=1:2=0.33:0.66.

The ester concentration is (2×0.33+2×0.66)/(33×0.33+19×0.66)=0.085.

Further, SP values of polyester resin (1) and polyester resin (5) are computed according to the method of Fedors, and the difference in SP values (ΔSP) obtained from these values is 0.6.

(Synthesis of Blocked Polyester Resin 2)

In the same manner as in the synthesis of blocked polyester resin 1, 60 weight parts of polyester resin (2) and 45 weight parts polyester resin (5) are blocked. After 6 hour at 130° C., polymerization is terminated when the molecular weight reached 23,000. The values of molar ratio and ester concentration of each block, and ΔSP computed are as shown in Table 2 below.

(Synthesis of Blocked Polyester Resin 3)

In the same manner as in the synthesis of blocked polyester resin 1, 60 weight parts of polyester resin (3) and 45 weight parts polyester resin (5) are blocked. After 13 hour at 145° C., polymerization is terminated when the molecular weight reached 29,500. The values of molar ratio and ester concentration of each block, and ASP computed are as shown in Table 2 below.

(Synthesis of Blocked Polyester Resin 4)

Poly-ϵ-caprolactone (100 weight parts) is subjected to ring opening polymerization by 1 weight part of tin octanoate and 2 weight parts of butanediol and poly-ϵ-caprolactone (PCP) having Mw of 14,000 is synthesized. Tg of poly-ϵ-caprolactone is −45° C. (calculation), and SP value is 9.52. In the same manner as in the synthesis of blocked polyester resin 1, 50 weight parts of poly-ϵ-caprolactone and 50 weight parts of polyester resin (6) are blocked. After 7 hour at 120° C., polymerization is terminated when the molecular weight reached 30,000. The values of molar ratio and ester concentration of each block, and ASP computed are as shown in Table 2 below.

(Synthesis of Blocked Polyester Resin 5)

In the same manner as in the synthesis of blocked polyester resin 1, 50 weight parts of polyester resin (1) and 50 weight parts of polyester resin (6) are blocked. After 8 hour at 140° C., polymerization is terminated when the molecular weight reached 35,000. The values of molar ratio and ester concentration of each block, and ΔSP computed are as shown in Table 2 below.

(Synthesis of Blocked Polyester Resin 6)

In the same manner as in the synthesis of blocked polyester resin 1, 50 weight parts of polyester resin (1) and 60 weight parts of polyester resin (7) are blocked. After 8 hour at 130° C., polymerization is terminated when the molecular weight reached 33,000. The values of molar ratio and ester concentration of each block, and ΔSP computed are as shown in Table 2 below.

(Synthesis of Blocked Polyester Resin 7)

In the same manner as in the synthesis of blocked polyester resin 1, 50 weight parts of polyester resin (4) and 50 weight parts of polyester resin (8) are blocked. After 5 hour at 130° C., polymerization is terminated when the molecular weight reached 28,000. The values of molar ratio and ester concentration of each block, and ΔSP computed are as shown in Table 2 below.

(Synthesis of Polyester Resin (9))

Polyester resin (1) (45 weight parts) and 50 weight parts of polyester resin (5) alone are dissolved together at 140° C. for 3 hours. Molecular weight Mw is 17,000, and it is confirmed from NMR that the peaks of the original resins are present. That is, polyester resin (9) is a mixture of polyester resin (1) and polyester resin (5).

(Synthesis of Polyester Resin (10))

In the same manner as in the synthesis of polyester resin (1), polyester resin (1) and polyester resin (5) are reacted except for changing the reaction temperature to 250° C., and the amount of dibutyltin oxide as the catalyst to 0.6 weight parts. The molecular weight Mw is 42,000, and it is confirmed from NMR that the peak is gentle as a whole, peaks of polyester resin (1) and polyester resin (5) have disappeared, and a peak of new bonding has appeared. From this result, it is thought that polyester resin (1) and polyester resin (5) used in the reaction have been decomposed, and new polyester resin is formed by the decomposed segments and the structure is randomized.

(Manufacture of Resin Particle Dispersion (1))

Blocked polyester resin 1 (100 weight parts) is put in a round glass flask equipped with a stirrer and dissolved at 120° C. for 30 minutes to be mixed. An aqueous solution for neutralization comprising 800 weight parts of ion exchange water heated at 95° C., 1.0 weight part of sodium dodecylbenzenesulfonate, and 1.0 weight part of 1N NaOH aqueous solution having been dissolved is poured into the flask and the mixed solution is emulsified for 5 minutes with a homogenizer (ULTRA-TURRAX, manufactured by IKA). The flask is further shaken in an ultrasonic wave bath for 10 minutes, and then cooled with water at room temperature to obtain resin particle dispersion (1) having a median diameter of 250 nm and a solid content of 20 wt %.

| (Manufacture of coloring particle dispersion (P1)) | |
|---|---|
| Cyan pigment (copper phthalocyanine C.I. Pigment Blue 15:3, manufactured by Dainichiseika Color & Chemicals Mfg. Co., Ltd.) | 50 weight parts |
| Anionic surfactant (Neogen R, manufactured by DAI-ICHI KOGYO SEIYAKU CO., LTD.) | 5 weight parts |
| Ion exchange water | 200 weight parts |

The above components are mixed and dissolved, and dispersed by a homogenizer (ULTRA-TURRAX, manufactured by IKA) for 5 minutes and by ultrasonic wave bath for 10 minutes to obtain cyan coloring particle dispersion (P1) having a median diameter of 190 nm, a solid content of 21.5%.

| (Manufacture of releasing particle dispersion (W1)) | |
|---|---|
| Anionic surfactant (Neogen R, manufactured by DAI-ICHI KOGYO SEIYAKU CO., LTD.) | 2 weight parts |
| Ion exchange water | 800 weight parts |
| Carnauba wax RC160 (manufactured by K.K. TOA, LTD.) | 200 weight parts |

The above components are mixed, heated at 100° C. and melted, and after that, emulsified with a homogenizer (ULTRA-TURRAX, manufactured by IKA) for 15 minutes, and then, further emulsified with a Gaulin homogenizer at 100° C.

Thus, releasing particle dispersion (W1) having a median diameter of 170 nm, a melting temperature of 83° C., and a solid content of 20% is obtained.

Example 1

| <Preparation of toner particles (1)> | |
|---|---|
| Resin particle dispersion (1) | 315 weight parts (resin: 63 weight parts) |
| Coloring particle dispersion (P1) | 40 weight parts (pigment: 8.6 weight parts) |
| Releasing particle dispersion (W1) | 40 weight parts (releasing agent: 8.0 weight parts) |
| Aluminum polychloride | 0.15 weight parts |
| Ion exchange water | 300 weight parts |

The above components are put in a round stainless steel flask and thoroughly mixed and dispersed with a homogenizer (ULTRA-TURRAX T50, manufactured by IKA), and then the flask is stirred in a heating oil bath and heated at 42° C. The flask is retained at 42° C. for 60 minutes, and then 105 weight parts of resin particle dispersion (1) (resin: 21 weight parts) is added and gently stirred.

Subsequently, pH in the system is adjusted to 6.0 with 0.5 mol/liter of a sodium hydroxide aqueous solution, the system is heated to 95° C. with continuing stirring. In general cases, pH in the system lowers to 5.0 or less during temperature ascendance to 95° C., but the sodium hydroxide aqueous solution is additionally dripped so that pH does not lower to 5.5 or lower.

After termination of the reaction, the reaction solution is cooled, filtered, washed with ion exchange water thoroughly, solid-liquid separated by Nutsche suction filtration, re-dispersed in 3 liters of ion exchange water at 40° C., stirred at 300 rpm for 15 minutes, and washed. The washing operation is repeated 5 times, solid-liquid separated by Nutsche suction filtration, and then dried by vacuum drying for 12 hours to obtain toner particles (1).

As a result of measurement of the particle size of toner particles (1) with Coulter Counter, cumulative volume average particle size $D_{50}$ (median diameter) is 5.1 μm and volume average particle size distribution index $GSD_v$ is 1.22. Shape factor SF1 of toner particles (1) found from shape observation with LUZEX is 129 and potato shapes.

<Preparations of External Toner (1) and Developer (1)>

To 50 weight parts of toner particles (1), 1.5 weight parts of hydrophobic silica (TS720, manufactured by Cabot) is added and mixed with a sample mill to obtain external toner (1).

By using ferrite carrier having an average particle size of 50 μm covered with polymethyl methacrylate (Mw: 75,000, manufactured by Soken Chemical & Engineering Co., Ltd.) by 1%, external toner (1) is weighed so that the toner concentration becomes 5%, and they are stirred and mixed in a ball mill to prepare developer (1).

Examples 2 to 4 and Comparative Examples 1 to 3

Toner particles, external toner and developer are respectively manufactured in the same manner as in the manufacture of resin particle dispersion (1) and Example 1 except for using each of the resins shown in Table 2 in place of blocked polyester resin 1.

The results of evaluations of toners and developers obtained in Examples 1 to 4 and Comparative Examples 1 to 5 are shown in Table 2.

TABLE 2

| | Example 1 | Comparative Example 1 | Example 2 | Example 3 | Example 4 | Comparative Example 2 | Comparative Example 3 | Comparative Example 4 | Comparative Example 5 |
|---|---|---|---|---|---|---|---|---|---|
| Resin | Blocked polyester Resin 1 | Blocked polyester Resin 2 | Blocked polyester Resin 3 | Blocked polyester Resin 4 | Blocked polyester Resin 5 | Blocked polyester Resin 6 | Blocked polyester Resin 7 | Polyester Resin (9) | Polyester Resin (10) |
| High Tg block | TPA/ BPA-2EO | TPA/ BPA-2EO | TPA/BPA-2PO/ BPA-2EO | CHDA/ BPA-2EO | TPA/BPA-2EO | TPA/BPA-2EO | TPA/C4 | — | — |
| Low Tg block | CHDA/C7 | CHDA/C7 | CHDA/C7 | PCPL | CHDA/ BPA-2EO | CC16/C12 | PDAA/C6 | — | — |
| Ester concentration | 0.085 | 0.086 | 0.079 | 0.082 | 0.061 | 0.055 | 0.12 | 0.085 | — |
| ΔSP | 0.6 | 0.6 | 0.6 | 0.5 | 0.3 | 1.6 | 0.06 | (0.6) | — |
| Mw | 41,000 | 23,000 | 29,500 | 30,000 | 35,000 | 33,000 | 28,000 | 17,000 | 42,000 |
| ΔTg (° C.) | 126 | 124 | 132 | 100 | 48 | 166 | 99 | (126) | — |
| Fine line reproducibility | A | C | A | B | B | C | C | C | C |
| Pressure fixation stability | A | B | A | A | B | C | C | C | C |
| Document offset | A | C | A | B | B | Cannot be fixed. | B | Cannot be fixed. | Cannot be fixed. |
| Molar ratio of blocked resin | 0.33/0.66 | 0.31/0.69 | 0.43/0.57 | 0.66/0.33 | 0.5/0.5 | 0.48/0.52 | 0.56/0.44 | 0.33/0.66 | 0.33/0.66 |
| $D_{50}$ (μm) | 5.1 | 5.2 | 5.1 | 5.6 | 5.0 | 5.2 | 5.4 | 5.6 | 5.1 |
| GSDv | 1.22 | 1.23 | 1.24 | 1.25 | 1.23 | 1.23 | 1.25 | 1.27 | 1.23 |
| SF1 | 129 | 128 | 128 | 121 | 128 | 127 | 128 | 126 | 128 |

Evaluations of examples and comparative examples are as follows.

The obtained developers, and a modified Docu Centre Color f 450 (a product of Fuji Xerox Co., Ltd.) are used, in which the heating roll is modified to a high hard roll by coating tetrahydrofuran on a SUS pipe, so that the maximum fixing pressure becomes 100 kgf/cm$^2$, and the two-roll type fixing unit is modified. Further, the pressure roll on the image side is modified to a high hard roll by coating Teflon (trademark) on a SUS pipe.

As the transfer-receiving paper, high quality Color Copy for catalog (250 g/m$^2$) designated by Fuji Xerox Co., Ltd. is used. The fixing abilities as shown below are examined by adjusting the process speed to 180 mm/sec.

<Evaluation of Halftone Fixing Ability by Pressure Fixation in the Case of Shifting from Under High Temperature High Humidity Environment to Under Low Temperature Low Humidity Environment>

Paper and toner are allowed to stand for 24 hours under the environment capable of maintaining the high temperature high humidity environment (28° C. 85% RH). At this time, as to paper, every 100 sheets of paper are bundled and allowed to stand on the same condition. After 24 hours, paper and toner are shifted to low temperature low humidity environment (10° C. 30% RH) and evaluated immediately. Concerning development test, entire halftone image and solid image are outputted and halftone fixing ability is confirmed.

[Evaluation of Halftone Fixing Ability]

A: Deficiency is not observed in any image all over the surface of paper.

B: A little deficiency is caused in a part of image.

C: Apparent image deterioration is caused.

<Evaluations of Pressure Fixation Stability in the Case of Shifting from Under High Temperature High Humidity Environment to Under Low Temperature Low Humidity Condition, and Document Offset>

Paper and toner are preserved under high temperature high humidity environment (28° C. 85% RH) for 24 hours, and after 24 hours, shifted to under low temperature low humidity environment (10° C. 30% RH) and continuous image output evaluation is performed with the apparatus set up the maximum fixing pressure at 50 kgf/cm$^2$. Every 10,000 sheets of paper are bundled, and allowed to stand under the environment of 10° C. 30% RH on the same condition. Solid images of 2 cm square are continuously outputted on 10,000 sheets of paper, every 500 sheet is sampled for confirmation of presence of image unevenness and splashing of the toner around the image. Other samples are piled immediately after output and allowed to stand under the same environment, and stickiness of images and document offset are evaluated after 4 hours.

[Evaluation of Fixing Stability]

A: Unevenness is not observed from the initial time to the final evaluation, and splashing of the toner is also not observed.

B: A little image deterioration and adhesion of the toner on the non-image area are observed.

C: Apparent image deterioration and adhesion of the toner on the non-image area are observed.

[Evaluation of Document Offset]

A: Image is free from stickiness and document offset does not occur.

B: Image stickiness and adhesion of the image-receiving area to other paper are observed a little.

C: Image stickiness and adhesion of the image-receiving area to other paper are apparently observed. (Occurrence of document offset. A slight sound is heard at the time of paper releasing.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A polyester resin for electrostatic image developing toner, comprising two or more polyester blocks, wherein the polyester resin satisfies the following conditions (A) to (C):

(A) an ester concentration of the polyester resin is about 0.01 or more and less than about 0.1;

(B) a weight average molecular weight of the polyester resin is about 24,000 or more; and (C) a difference in solubility parameter values (SP values) of at least two kinds of the two or more polyester blocks is about 0.1 to about 0.7, and the ester concentration is computed from monomers constituting the block polyester by the following equation (1)

$$M=K/A \quad (1),$$

wherein M represents ester concentration,

K represents a number of ester bonds in the polyester resin, and

A represents a number of atoms constituting the polymer chain of the polyester resin.

2. The polyester resin according to claim 1, wherein each of the two or more polyester blocks has a weight average molecular weight Mw of about 8,000 to about 500,000.

3. The polyester resin according to claim 1, wherein a difference in glass transition temperatures (ΔTg) of at least two kinds of the two or more polyester blocks is about 50° C. or more.

4. The polyester resin according to claim 1, wherein at least one of the two or more polyester blocks is an amorphous polyester block.

5. The polyester resin according to claim 1, wherein at least one polyester block of the two or more polyester blocks has a glass transition temperature (Tg) of less than about 40° C.

6. The polyester resin according to claim 1, wherein at least one polyester block of the two or more polyester blocks has a Tg of about 50° C. or more.

7. The polyester resin according to claim 1, satisfying the following relationship:

$$\text{about } 0.4 < Mn(H)/Mn(L) < \text{about } 3.0$$

wherein, of two kinds of the two or more polyester blocks,

Mn(H) represents a number average molecular weight Mn of the polyester block having a higher Tg; and Mn(L) represents a number average molecular weight Mn of the polyester block having a lower Tg.

8. The polyester resin according to claim 1, which has a softening temperature of about 70° C. to about 120° C.

9. The polyester resin according to claim 1, satisfying the following relationship:

$$\text{about } 20^\circ\text{ C.} \leqq T(P1)-T(P30) \leqq \text{about } 120^\circ\text{ C.}$$

wherein T(P1) represents a temperature at a time when a viscosity becomes $10^4$ Pa·s at flow tester application pressure of 1 MPa (10 kgf/cm$^2$); and T(P30) represents a temperature at a time when a viscosity becomes $10^4$ Pa·s at flow tester application pressure of 30 MPa (300 kgf/cm$^2$).

10. A manufacturing method of the polyester resin for electrostatic image developing toner according to claim 1, the method comprising:

manufacturing a polyester resin A;

manufacturing a polyester resin B; and reacting at least the polyester resin A and the polyester resin B to manufacture a polyester resin containing at least a polyester block A derived from the polyester resin A and a polyester block B derived from the polyester resin B.

11. The manufacturing method according to claim 10, wherein a sulfur acid is used as a polycondensation catalyst.

12. The manufacturing method according to claim 11, wherein a use amount of the polycondensation catalyst is about 0.01 to about 5 mol % to all amount of polycondensation monomers.

13. An electrostatic image developing toner, comprising:

the polyester resin for electrostatic image developing toner according to claim 1; and a releasing agent.

14. The electrostatic image developing toner according to claim 13, wherein a blending amount of the releasing agent is in a range of about 5 to about 30 wt % based on a total weight of solids content constituting the toner.

15. The electrostatic image developing toner according to claim 13, which has a volume average particle size ($D_{50}$) of about 3.0 to about 20.0 μm.

16. The electrostatic image developing toner according to claim 13, which has a volume average particle size distribution GSDv of about 1.4 or less.

17. The electrostatic image developing toner according to claim 13, which has a shape factor SF1 of about 100 to about 140.

18. An electrostatic image developer, comprising:

the electrostatic image developing toner according to claim 13; and a carrier.

19. The electrostatic image developer according to claim 18, wherein the carrier is a resin-covered carrier.

* * * * *